United States Patent [19]

Slaughter

[11] Patent Number: 4,770,679

[45] Date of Patent: Sep. 13, 1988

[54] DUST FILTER FOR TOILET TISSUE

[76] Inventor: Omer Slaughter, 1031 State St., Gassay, W. Va. 26624

[21] Appl. No.: 936,717

[22] Filed: Nov. 25, 1986

[51] Int. Cl.[4] ..... B01D 46/00

[52] U.S. Cl. ..... 55/279; 55/315; 55/385.1; 242/55.53; 242/55.55; 422/5; 422/124

[58] Field of Search ..... 55/279, 385 R, 385 C, 55/385 F, 315; 239/34, 289, 57–59; 242/55.53, 55.55; 422/5, 124

[56] References Cited

U.S. PATENT DOCUMENTS 2,440,974 5/1948 Resch ..... 242/55.55

3,329,367 7/1967 Paradiso ..... 242/55.55

3,820,308 6/1974 Onuki ..... 55/279

4,154,251 5/1979 Doyel ..... 55/279 X

*Primary Examiner*—Charles Hart

*Attorney, Agent, or Firm*—Don E. Ferrell

[57] ABSTRACT

A filter assembly for use in combination with a toilet tissue dispenser includes a housing in which a roll of toilet tissue is mounted. A motor driven blower is positioned in the housing and serves to remove dust and loose fibers by directing a flow of air over the tissue roll. A removable filter captures the loose dust and fibers. Additionally, perfume granules or the like may be retained in the housing so as to provide the clean exhaust air with a pleasant odor.

10 Claims, 3 Drawing Sheets

FIG 6
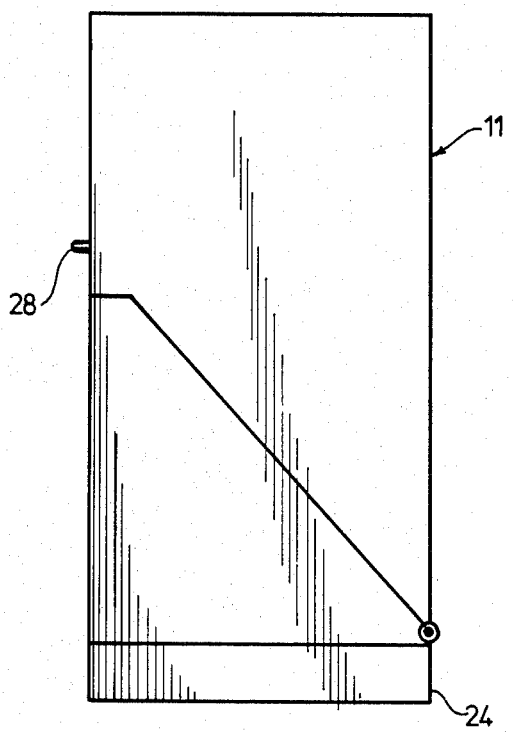
FIG 7
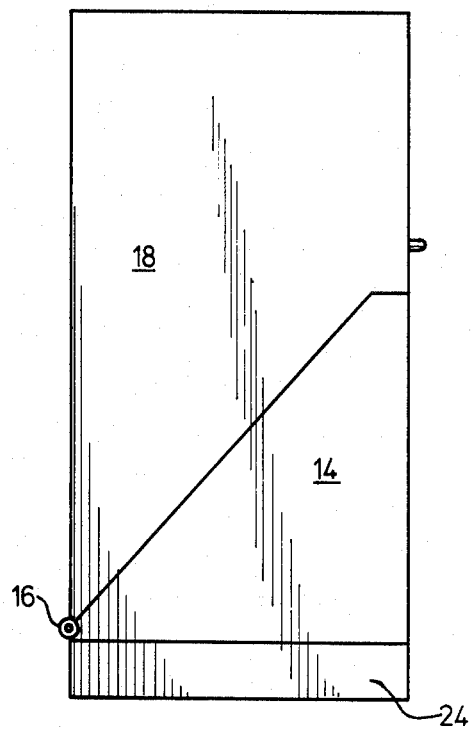
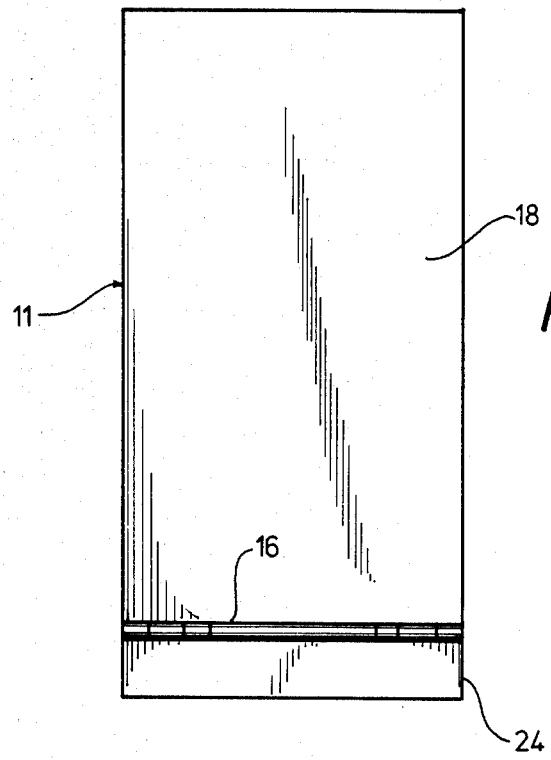
FIG 8

DUST FILTER FOR TOILET TISSUE

BACKGROUND OF THE INVENTION

1. Field of the Invention

The present invention relates to air filter devices, and more particularly pertains to a new and improved air filtering unit utilizable in conjunction with a toilet tissue dispenser.

2. Description of the Prior Art

The use of air filtering devices designed to remove dust and other particles from the air is well known in the prior art. For example, reference is made to U.S. Pat. No. 4,490,881, which issued to O. Schmidt on Jan. 1, 1985. The Schmidt device is effectively a dust exhaustor mountable beneath the work top of a conventional work table. The unit includes a suction opening for drawing a flow of air through a filter, thereby to remove air borne dust, fibers and other debris.

Similarly, U.S. Pat. No. 4,560,395, which issued to G. Davis on Dec. 24, 1985, discloses a compact blower and filter assembly for use in clean air environments. This device also utilizes a motor driven air movement blower which effects a flow of air through a filter, thus to remove dust and other debris from the breathable air.

The above-discussed prior art assemblies are illustrative of a far greater number of patents which could have been provided and all of which relate to such motor-driven blowers in conjunction with filters. While all of these devices are functional for their intended purposes, apparently no such filtering device has been developed which is particularly designed for use in conjunction with a toilet tissue dispenser. Inasmuch as the tearing of toilet tissue effects a substantial release of dust and other fibers into the breathable air environment, it can be appreciated that there is a need for removing such tissue dust and fibers from the air so as to prevent potential lung damage to individuals who might otherwise breathe such contaminated air. In this respect, the present invention substantially fulfills this need.

SUMMARY OF THE INVENTION

In view of the foregoing disadvantages inherent in the known types of air filtering assemblies now present in the prior art, the present invention provides an improved air filtering assembly wherein the same can be compactly and efficiently mounted in a toilet tissue dispenser, thereby to remove dust and fibers released upon a tearing of a tissue. As such, the general purpose of the present invention, which will be described subsequently in greater detail, is to provide a new and improved air filtering assembly which has all the advantages of the prior art air filtering assemblies and none of the disadvantages.

To attain this, the present invention comprises a motor driven blower fixedly mounted within a toilet tissue dispenser housing. The blower effects a flow of air over an enclosed roll of toilet tissue, with this flow of air serving to remove dust, fibers and other debris released upon a tearing of a tissue. The flow of air moves through a filter which captures all of the released dust and fibers, and the filter may be exchanged or removed for cleaning when desired. Additionally, a tray of perfume granules, or other aromatic substances, is positioned within the air flow path, whereby the exhausted clean air is provided with a pleasant odor.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is to intended to be limiting as to the scope of the invention in any way.

It is therefore an object of the present invention to provide a new and improved air filtering assembly which has all the advantages of the prior art air filtering assemblies and none of the disadvantages.

It is another object of the present invention to provide a new and improved air filtering assembly which may be easily and efficiently manufactured and marketed.

It is a further object of the present invention to provide a new and improved air filtering assembly which is of a durable and reliable construction.

An even further object of the present invention is to provide a new and improved air filtering assembly which is susceptible of a low cost of manufacture with regard to both materials and labor, and which accordingly is then susceptible of low prices of sale to the consuming public, thereby making such air filtering assemblies economically available to the buying public.

Still yet another object of the present invention is to provide a new and improved air filtering assembly which provides in the apparatuses and methods of the prior art some of the advantages thereof, while simultaneously overcoming some of the disadvantages normally associated therewith.

Still another object of the present invention is to provide a new and improved air filtering assembly which is particularly adapted for use with a toilet tissue dispenser.

Yet another object of the present invention is to provide a new and improved air filtering assembly which also provides for the deodorizing of air passing therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a right side elevation view of the invention.

FIG. 7 is a left side elevation view of the invention.

FIG. 8 is a rear elevation view thereof.

DESCRIPTION OF THE PREFERRED EMBODIMENT

Figure 1:
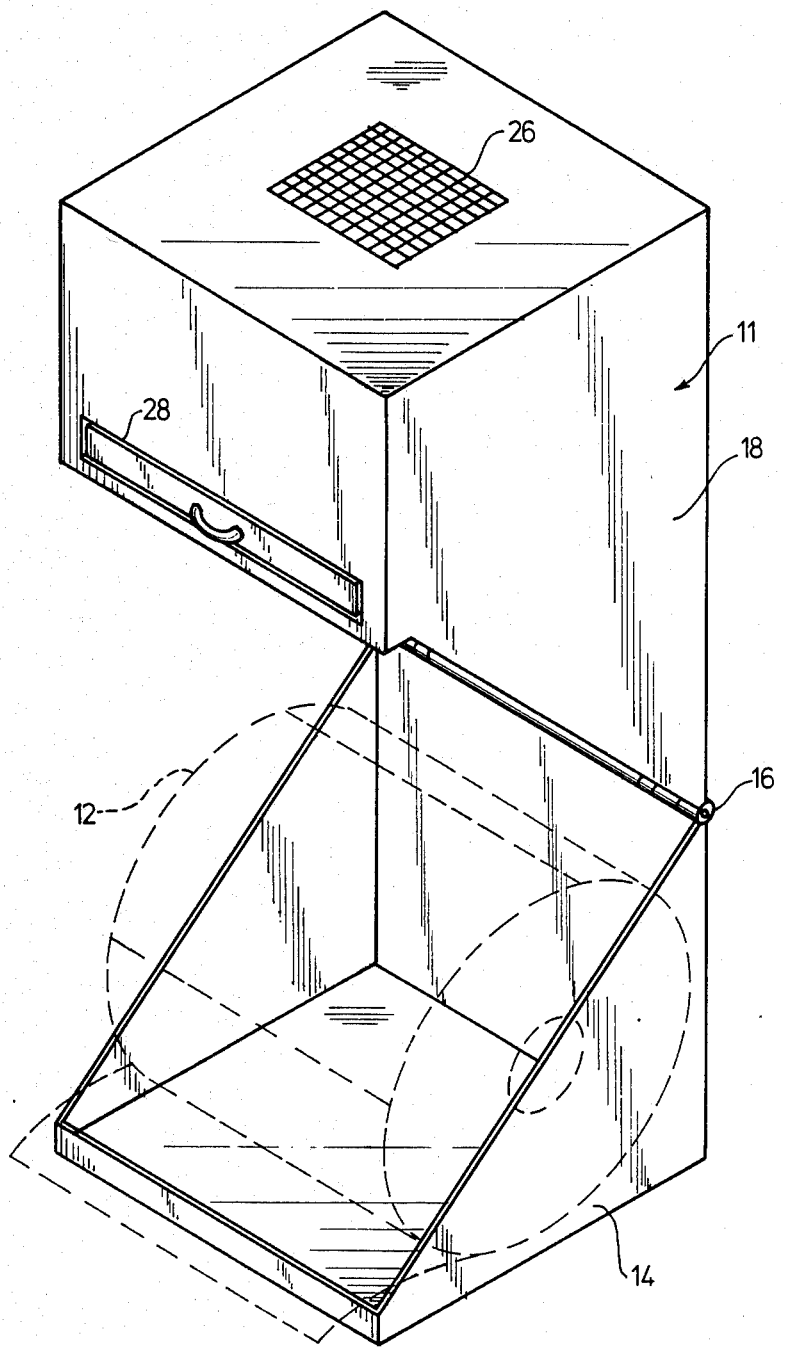
FIG. 1 is a perspective view of the toilet tissue air filtering assembly comprising the present invention.

With reference now to the drawings, and in particular to FIGS. 1–8 thereof, a new and improved air filtering assembly for use with a toilet tissue dispenser embodying the principles and concepts of the present invention and generally designated by the reference numeral 10 will be described.

Figure 2:
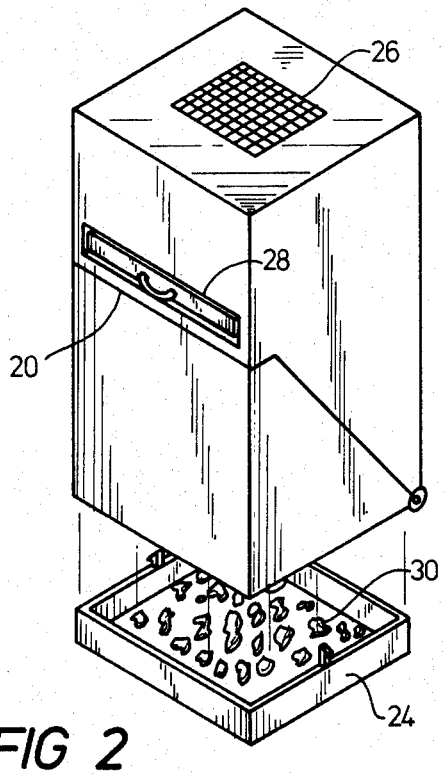
FIG. 2 is an exploded perspective view of the assembly showing a perfume granules holding tray attachable thereto.

More specifically, it will be noted that the toilet tissue air filtering assembly 10 essentially comprises a housing 11 designed to retain a rotatable roll of toilet tissue 12. The tissue 12 is retained within a lower housing section 14 which is pivotally attached by a hinge 16 to an upper housing section 18. When the housing section 14 is pivoted upwardly into engagement with the housing section 18, a conventional lockable engagement therebetween is achieved as best illustrated in FIG. 2. When the sections 14, 18 are in engagement, a tissue paper dispensing slot 20 is defined whereby the roll of toilet tissue 12 is completely hidden from view.

Figure 3:
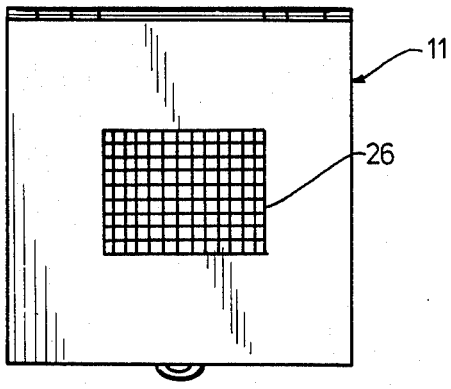
FIG. 3 is a top plan view of the invention.
Figure 4:
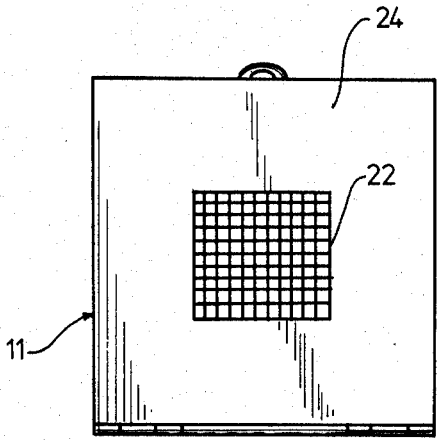
FIG. 4 is a bottom plan view of the invention.

Mounted in a top portion of the upper housing section 18 is a motor driven blower of a conventional design. The blower effects a flow of air upwardly through an air intake screen 22 formed in a bottom wall section 24 of the housing 11 as best illustrated in FIG. 4. The air is drawn over the tissue roll 12, so as to remove dust and fibers therefrom, and is then exhausted through a top screen port 26 as best illustrated in FIGS. 1, 2 and 3. The unillustrated blower is of a conventional design, such as the one utilized in the aforediscussed Schmidt patent, and the disclosure of that patent is incorporated herein by reference.

Figure 5:
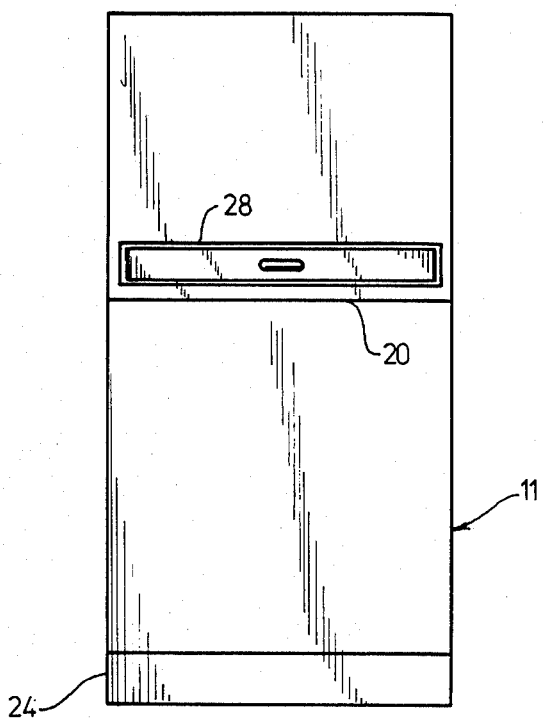
FIG. 5 is a front elevation view of the air filtering assembly.

As best illustrated in FIGS. 1, 2 and 5, a slidably removable tray 28 is mounted in the upper housing section 18. The tray 28 contains a conventional air filter which is positionable across the air flow path passing through the housing 11. The filter 28 serves to capture dust, fibers and other debris, and may then be removed for cleaning or exchange, whereby only clean air is then exhausted outwardly through the screened port 26.

As best illustrated in FIG. 2 of the drawings, the bottom wall section 24 may be released from the lower housing section 18. As shown, the bottom wall section 24 effectively comprises a container for holding a plurality of perfume granules 30, or some similar aromatic substance, and the air being drawn inwardly through the screened port 22 must pass through these granules. Accordingly, a pleasant odor is imparted to the air passing through the granules 30, and the filter 28 will now remove this odor from the air. As such, clean air exhausted outwardly from the screened port 26 is also provided with a pleasant odor.

With respect to the manner of usage and operation of the present invention, the same should be apparent from the above description. However, a brief summary thereof will be provided. In this respect, it can be appreciated that a roll of toilet tissue 12 may be rotatably secured within the lower housing section 14 by releasing the section downwardly in the manner best illustrated in FIG. 1. The lower housing section 14 is then snap fitted into engagement with the upper housing section 18, and the toilet tissue 12 may then be drawn outwardly through the toilet tissue dispensing slot 20. An unillustrated power switch powers the blower assembly to achieve an air flow through the housing 11 and over the toilet tissue 12. The filter 28 will remove dust, fibers and other debris from the toilet tissue 12, while the perfume granules 20 will impart a pleasant odor to the air dispensed outwardly through the screened port 26.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved air filtering assembly for use in a toilet tissue dispenser, said assembly comprising:

housing means for retaining said toilet tissue;

blower means for drawing a flow of air through said housing means, said flow of air passing over said toilet tissue so as to remove dust, fibers and other debris therefrom;

and filtering means removably mounted in said housing means, said flow of air passing through said filtering means after passing over said toilet tissue.

2. The new and improved air filtering assembly for use in a toilet tissue dispenser as described in claim 1, wherein said filtering means is retained within a slidably removable drawer positioned in said housing means.

3. The new and improved air filtering assembly for use in a toilet tissue dispenser as described in claim 2, wherein said housing means comprises first and second sections pivotally attached together, said first and second sections being pivotally separable to effect a positioning of said toilet tissue within said housing means.

4. The new and improved air filtering assembly for use in a toilet tissue dispenser as described in claim 3, and further including deodorizing means mounted in said housing means.

5. The new and improved air filtering assembly for use in a toilet tissue dispenser as described in claim 4, wherein said deodorizing means is positioned within a path of said flow of air, thereby to deodorize said air passing through said housing means.

6. The new and improved air filtering assembly for use in a toilet tissue dispenser as described in claim 5, wherein said deodorizing means is retained within a removable tray attached to a bottom portion of said housing means.

7. The new and improved air filtering assembly for use in a toilet tisuse dispenser as described in claim 6, wherein said deodorizing means includes a use of perfume means, thereby to impart a pleasant odor to said air passing through said housing means.

8. The new and improved air filtering assembly for use in a toilet tissue dispenser as described in claim 7, wherein said blower means utilizes an electrically powered motor.

9. The new and improved air filtering assembly for use in a toilet tissue dispenser as described in claim 8, wherein said blower means is mounted within said housing means.

10. The new and improved air filtering assembly for use in a toilet tissue dispenser as described in claim 9, wherein said housing means is provided with screened intake and exhaust air ports.

* * * * *